United States Patent [19]

Griffin

[11] 4,216,951

[45] Aug. 12, 1980

[54] BABY CHANGING APPARATUS

[76] Inventor: Barbara J. Griffin, 4288 Main St., Box 148, Brown City, Mich. 48416

[21] Appl. No.: 968,193

[22] Filed: Dec. 11, 1978

[51] Int. Cl.[2] ..... A61G 13/00

[52] U.S. Cl. ..... 269/328; 108/134; 269/321 CF

[58] Field of Search ..... 269/328, 321 CF; 108/134, 152, 27

[56] References Cited

U.S. PATENT DOCUMENTS

| | | | |
|---|---|---|---|
| 2,735,737 | 2/1956 | Hancock | 108/134 |
| 3,156,197 | 11/1964 | Walz | 108/27 |
| 4,067,565 | 1/1978 | Daniels | 269/328 |

*Primary Examiner*—Robert C. Watson

*Attorney, Agent, or Firm*—Irving M. Weiner; Pamela S. Burt; Melvin Yedlin

[57] ABSTRACT

A baby-changing apparatus for use in public rest rooms or other places where space is limited is provided with a padded table bearing a roll of paper and a cutting and retaining bar, which can be positioned parallel to a vertical mounting surface when not in use, or supported and retained in a horizontal position for use by a hinged bracket with a vertical projection at its outermost end, which bears against the outermost edge of the table and prevents unintentional movement of the bracket. The roll of paper and cutting and retaining bar are adapted to provide a clean table surface prior to use. The table is provided with a safety belt with a tongueless friction buckle.

8 Claims, 4 Drawing Figures

BABY CHANGING APPARATUS

The present invention relates to a baby-changing apparatus adapted to be foldably mounted to a vertical support, such as walls and partitions in public rest rooms in restaurants, department stores, airports and the like, and other places where space is limited and a safe surface is required for the convenience of those with babies who require a change of diapers.

BACKGROUND OF THE INVENTION

There have been numerous attempts to provide folding horizontal surfaces for various purposes, including the provision of a surface for use in changing a baby's diaper. Illustrative of the prior art known to applicant are U.S. Pat. Nos. 1,898,865, 2,735,737, 3,156,197, and 3,364,885.

U.S. Pat. No. 1,898,865, issued in 1931 to Balch, entitled "SUPPORT" discloses a hinged shelf, and spring loaded bracket, adjustable by means of bolt and nut connections or a single headed bolt.

U.S. Pat. No. 2,735,737, issued in 1956 to Hancock, entitled "DIAPERING SUPPORT" discloses a fold-down table supported by foldable scissor-like arms, and provided with a container mounted to a wall, containing a roll of paper and having a serrated edge, intended as a relatively tamper-proof baby changing table for use in public restrooms.

U.S. Pat. No. 3,156,197 issued in 1964 to Walz, entitled "IMPLEMENT FOR BABY CARE" discloses a portable, collapsable changing table or playing table, which may rest upon another table or upon the edges of a bath tub or crib.

U.S. Pat. No. 3,364,885, issued in 1968 to Brothers, entitled "UTILITY SHELF" discloses a spring loaded shelf which swings upwardly, against a wall, when weight is removed.

Although some of the prior art devices are usable as a baby changing apparatus, they present various difficulties which would impair the safety of an infant, and are too complex, cumbersome, and expensive.

SUMMARY OF THE INVENTION

The primary object of the invention is the provision of a safe, convenient, and space-saving structure for a baby changing apparatus.

It is a further object of the invention to provide a baby changing apparatus having an inexpensive renewable sanitary surface.

It is a further object of the invention to provide a baby changing apparatus which is simple and inexpensive to manufacture.

DESCRIPTION OF THE PREFERRED EMBODIMENT

In general, the baby-changing apparatus of the invention consists of an elongated table member, which is hinged to a spacer member, which in turn is attached to a wall or the like. The table member is padded, and provided with a belt with a friction buckle to safely retain an infant. The table member is provided with a roll of paper and a cutting edge to provide a renewable sanitary surface, and is supported on a single hinged bracket with a protrusion at its end to prevent unintentional movement. The spacer member permits the table member to assume a position parallel to a wall or the like when not in use.

Referring more particularly to the drawings, since all figures illustrate the same preferred embodiment, indentical numbering will be used whenever possible.

Spacer 2 is attached to wall 1 in a conventional manner, and may be supported on brackets or the like. It is preferable, although not necessary, that spacer 2 be provided with triangular members on its underside, adjacent its ends, to serve as support brackets.

Figure 1:
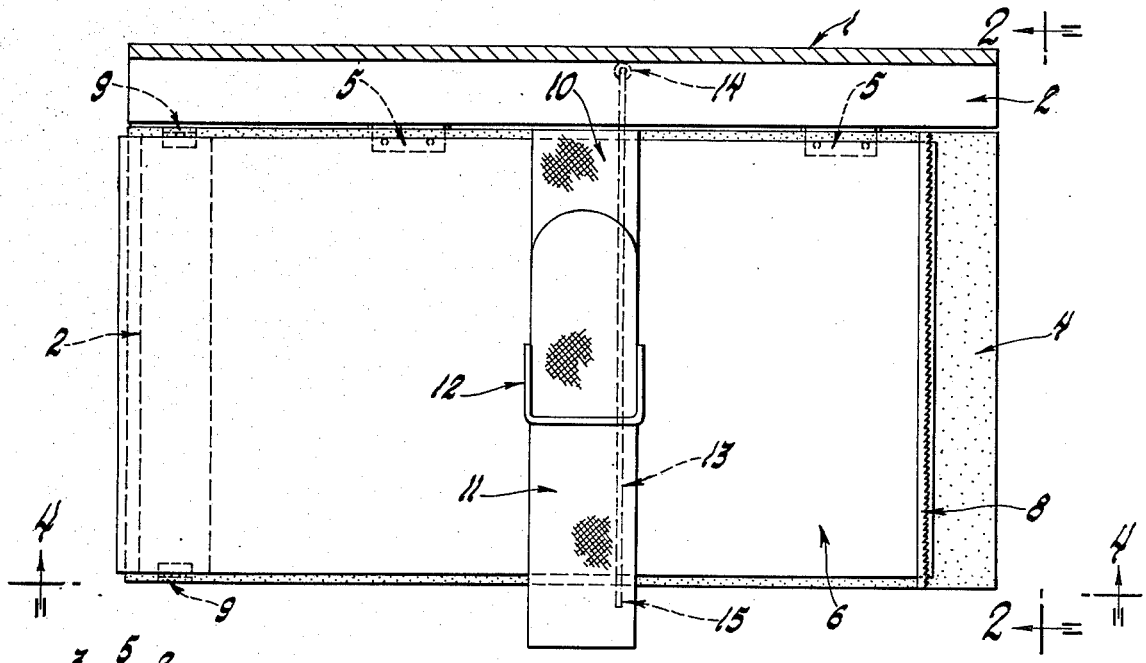
FIG. 1 is a top elevation of a baby changing apparatus according to a preferred embodiment of the invention.
Figure 3:
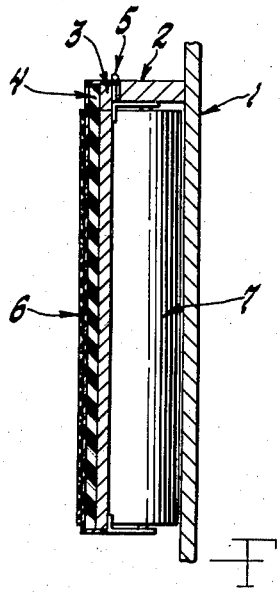
FIG. 3 is a side elevation of the preferred embodiment of the invention in lowered position.

Hinges 5, which are conventional hinges in the preferred embodiment, connect spacer 2 with table 3, which is most clearly shown in FIG. 3. Table 3, in the preferred embodiment, is approximately 18 by 30 inches (45.7 by 76.2 cm), and is upholstered with padding 4, which is about 1 to 2 inches (25.4 to 50.8 mm) thick in the preferred embodiment. Padding 4 may be a synthetic rubber foam with a vinyl covering, if desired.

Cutter bar 8 is disposed above padding 4, and serves both to retain and to cut paper 6. In the preferred embodiment, cutter bar 8 is made from plated metal, although this is not necessary to practice the invention, and is provided with cutting teeth. It is apparent that a plastic strap, of a tough, flexible but non-resilient material could be substituted with favorable results, although with less durability. In the preferred embodiment, cutter bar 8 is attached to the outermost edges of table 3, although this is not necessary to practice the invention, and cutter bar 8 could be mounted to table 3 in other ways, such as through grommeted holes in padding 4.

Paper 6 is supplied from roll 7, supported below table 3 by brackets 9, on a rod, (not shown) which passes through brackets 9 and roll 7, and is retained in conventional fashion. In the preferred embodiment, the rod has a head on one end, and threads on the other, and is retained by a wing nut.

If greater resistance to tampering is desired, it is possible although more costly, to provide one of the brackets 9 with a threaded aperture into which the rod screws, and place a non-standard head such as a clutch head, or a socket head, or a cap screw head on the rod, so that an uncommon tool is required to remove the rod.

The paper 6 is guided from roll 7, over table 3 and padding 4, and under cutter bar 8, so that a clean surface can be provided on the baby changing apparatus prior to each use, by pulling the paper out a distance approximately equal to the length of table 3, and tearing off the soiled portion by an upward twisting motion of the paper 6 against cutter bar 8. A two piece belt, 10 and 11, is attached to the sides of table 3, and provided with a tongueless friction buckle 12, so that it can be easily adjusted to safely and securely retain an infant placed on padding 4.

Figure 2:
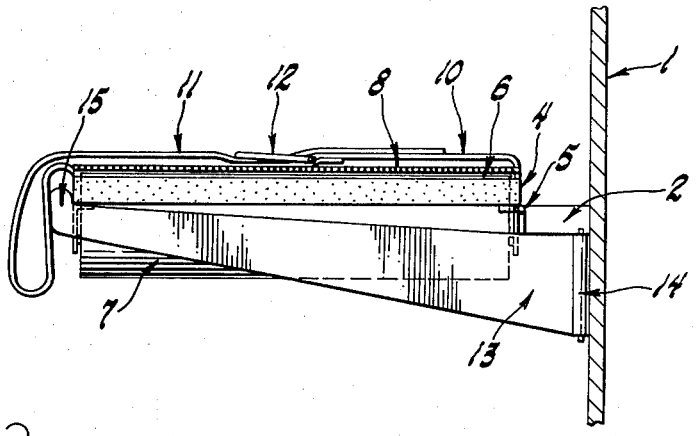
FIG. 2 is a side elevation of a baby changing apparatus according to the preferred embodiment shown in FIG. 1.
Figure 4:
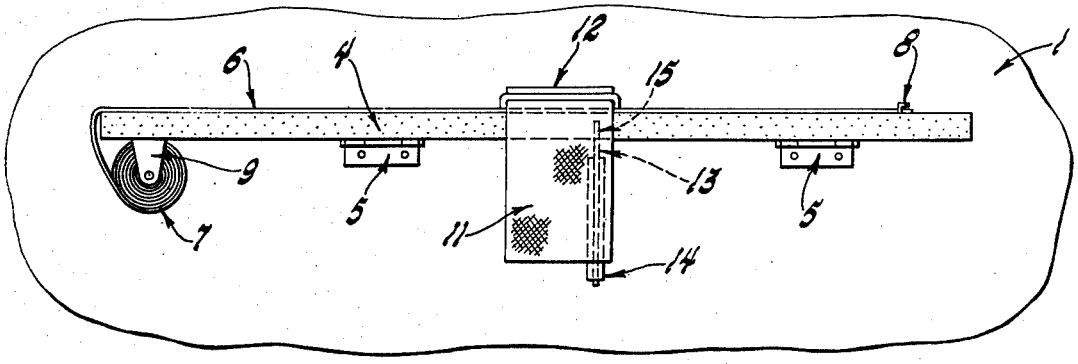
FIG. 4 is a front elevation of the preferred embodiment of the invention as shown in FIG. 1.

As shown in FIG. 2, table 3 is retained in horizontal position by bracket 13, which is attached to vertical wall 1 by a conventional hinge 14. In the preferred embodiment, hinge 14 is not provided with any biasing means, although it is apparent that bracket 13 could be urged to a position perpendicular to wall 1 by a spring associated with hinge 14, although so doing would result in an increase in cost and a decrease in durability. Also, hinges 5 could be provided with spring-loaded detent means for holding the table 3 in raised position while bracket 13 is moved into position to support the weight of an infant, with attendant increases in costs and reduction in durability.

Bracket 13 is provided with vertical protrusion 15 at its outermost end, so that, once bracket 13 is in position for use, protrusion 15 will bear against the edge of table 3 and prevent angular movement of bracket 13 until table 3 is disengaged from projection 15 by an intentional lifting motion.

FIG. 3 shows the baby-changing apparatus of the preferred embodiment of the invention in its storage position, with table 3 parallel to wall 1. FIG. 3 also illustrates that spacer 2 is intended to allow this position of table 3 without interference from paper roll 7. In the preferred embodiment, the initial diameter of paper roll 7 and the width of spacer 2 are both approximately 3 inches (7.6 cm), although, if a larger roll of paper is desired, a corresponding change in the width of spacer 2 can be made.

In use, the preferred embodiment of the baby-changing apparatus would be mounted to wall 1 at a distance from the floor greater than normal table height, at about the average waist height of a standing person, so that table 3 and bracket 13 can be moved into position for use, by the simple, one-handed action of reaching under table 3 and seizing bracket 13, and pulling bracket 13 outward while lifting table 3 with the forearm. The table width of 18 inches (45.7 cm) and the preferred mounting height of approximately 40 inches (101.6 cm) may both be decreased to match the average anthropometric dimensions of a given class of potential users.

The invention has been described with respect to a preferred embodiment but it is to be understood that numerous modifications may be made to the invention by persons skilled in the art without departing from the spirit and scope of the invention.

I claim:

1. A baby-changing apparatus comprising:

spacer means adapted to be attached to a vertical supporting surface;

table means hingedly attached to said spacer means;

means for retaining a roll of paper disposed on a first side of said table means;

means for cutting and retaining a strip of paper disposed on a second side of said table means;

support bracket means disposed beneath said table means, said support bracket means being adapted to be hingedly attached to said vertical supporting surface, and being provided with means for engaging an outermost edge of said table means to prevent unintentional movement of said support bracket means when said bracket means is disposed in a first predetermined position;

said table means being disposed substantially perpendicular to said vertical supporting surface when said support bracket means is in said first predetermined position, and said table means being disposed substantially parallel to said vertical supporting surface when said support bracket means is in a second predetermined position.

2. A baby-changing apparatus according to claim 1, wherein:

said table means is covered on said second side with substantially flat padding over a substantial part of said second side of said table means.

3. A baby-changing apparatus according to claim 1, wherein:

said table means is provided with a two-piece belt, having a pair of free ends firmly attached to said table means, said belt being provided with a tongueless buckle to adjustably connect a second pair of free ends of said belt.

4. A baby-changing apparatus according to claim 1, wherein:

said means for cutting and retaining a strip of paper comprises a metallic toothed bar member disposed in the width dimension of said table means, and rigidly attached to said table means.

5. A baby-changing apparatus according to claim 1, wherein:

said means for cutting and retaining a strip of paper comprises a plastic toothed bar member disposed in the width direction of said table means, and rigidly attached to said table means.

6. A baby-changing apparatus according to claim 1, wherein:

said means for cutting and retaining a strip of paper comprises a smooth flexible plastic strip member disposed in the width direction of said table means, and rigidly attached to said table means.

7. A baby-changing apparatus according to claim 1, wherein:

said means for engaging an outermost edge of said table means is a vertical protrusion provided at an end of said support bracket means distal to said vertical supporting surface.

8. A baby-changing apparatus according to claim 1, wherein:

said support bracket means is substantially in the form of a cantilever beam, having a vertical projection at an end distal to said vertical supporting surface.

* * * * *